US005735562A

United States Patent [19]

Borg

[11] Patent Number: 5,735,562

[45] Date of Patent: Apr. 7, 1998

[54] MULTI-CONTAINER CARRIER

[75] Inventor: James C. Borg, Eugene, Oreg.

[73] Assignee: Oregon Precision Industries, Inc., Eugene, Oreg.

[21] Appl. No.: 801,523

[22] Filed: Feb. 18, 1997

[51] Int. Cl.[6] ..... B65D 71/00

[52] U.S. Cl. ..... 294/87.2; 206/151; 294/159

[58] Field of Search ..... 294/27.1, 31.2, 294/87.2–87.28, 159, 170; 206/139, 143, 145, 147, 148, 150, 151, 162, 199, 201, 427

[56] References Cited

U.S. PATENT DOCUMENTS

D. 277,554 2/1985 Chabot .
4,159,841 7/1979 Calvert ..... 294/87.2
4,235,468 11/1980 Erickson .
4,678,221 7/1987 Josenhans .
5,306,060 4/1994 Borg .
5,346,271 9/1994 Erickson .
5,480,204 1/1996 Erickson ..... 294/87.2

*Primary Examiner*—Johnny D. Cherry
*Attorney, Agent, or Firm*—Chernoff, Vilhauer, McClung & Stenzel, LLP

[57] ABSTRACT

An integral carrying strap for carrying containers with annular neck flanges having multiple neck-engagement ring structures wherein each ring structure has a neck-capturing and -releasing distal portion and a weight-bearing proximal portion.

10 Claims, 4 Drawing Sheets

1
10
11
11A
11B
13
14
20
20D
20P
30D
30P
40
40D
40P
43
50
60D
60P
63
70

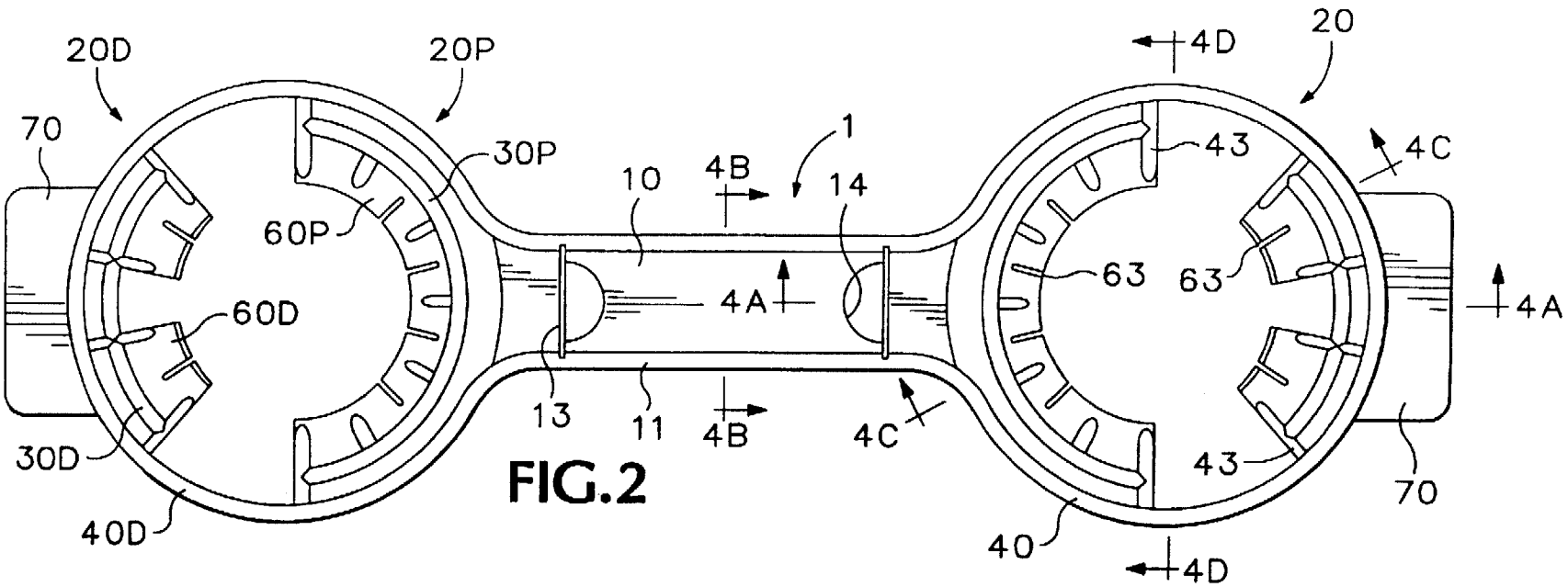
FIG.2
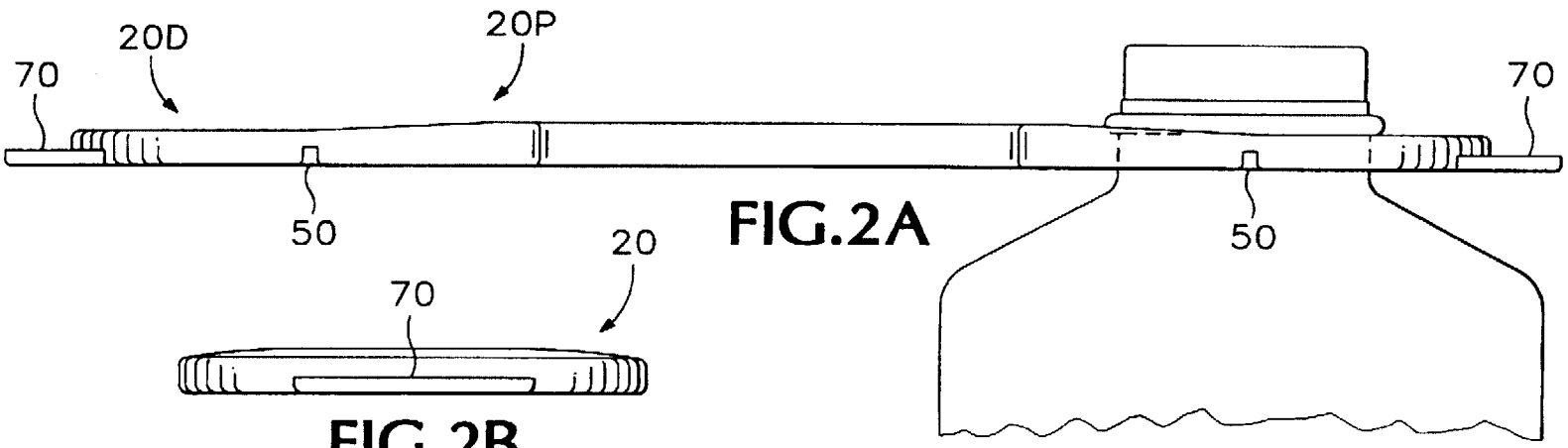
FIG.2A
FIG.2B

MULTI-CONTAINER CARRIER

BACKGROUND OF THE INVENTION

Two-ring jug or bottle carrier straps which hold jugs or bottles by their necks to allow them to be carried are well known. See, for example, U.S. Pat. Nos. Re. 35,288, 4,471,987, 4,249,766 and 4,235,468. Heavier containers having annular flanges in their necks have presented a particularly troublesome problem for accommodating such carrier straps in that the neck-engaging rings of the strap are required to be sufficiently resilient to fit over the larger diameter of the neck flange while at the same time having a sufficiently small diameter to fit snugly against the smaller diameter of the container neck immediately below the flange and having sufficient tensile strength to support the weight of the container. The principal drawbacks of prior two-ring carrier straps are difficulty in achieving a balance among these competing design factors and especially in achieving a quick and easy release of the strap from the container neck.

SUMMARY OF THE INVENTION

The present invention comprises an improved design in multi-ring carrier straps capable of carrying two, three or four containers by essentially dividing each neck-engaging ring into a distal neck-capturing and neck-releasing portion and a proximal weight-bearing portion, the former permitting easy engagement and disengagement of a container neck, and the latter resisting large downward forces. These features are achieved by providing each ring with a pair of notches on the bottom side of an outer circumferential rib so as to permit flexible upward hinging of the distal portion of the ring relative to the proximal portion, together with inner proximal and distal arcuate ribs within an outer circumferential rib wherein the inner proximal rib has greater tensile strength than does the inner distal rib, and inwardly projecting flanges from the inner ribs wherein the distal flanges project further inwardly and have greater flex and less tensile strength than the proximal flanges.

BRIEF DESCRIPTION OF THE SEVERAL VIEWS OF THE DRAWINGS

FIG. 2 is a plan view of the carrier shown in FIG. 1 including pry tabs on each ring, and showing where the sectional views of FIGS. 4A–4D are taken.

FIG. 2A is a side view of the carrier FIG. 2.

FIG. 2B is an end view of the carrier shown in FIG. 2.

DETAILED DESCRIPTION OF THE INVENTION

Figures 1, 4A, 4B:
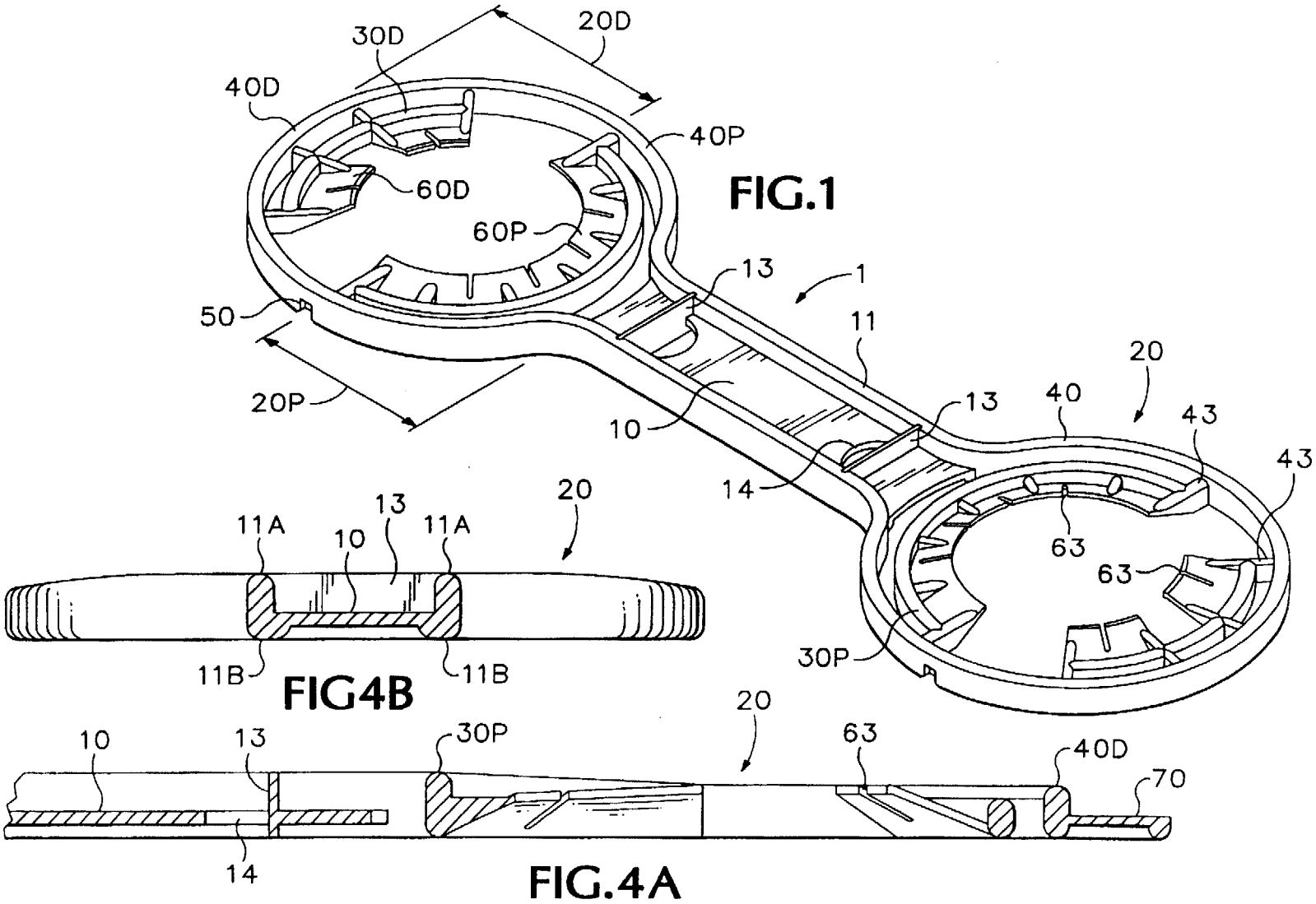
FIG. 1 is a perspective view of an exemplary two-ring integral carrier of the present invention.
FIG. 4A is a sectional view taken through the plane A—A of FIG. 2.
FIG. 4B is a sectional view taken through the plane B—B of FIG. 2.
Figure 4C:
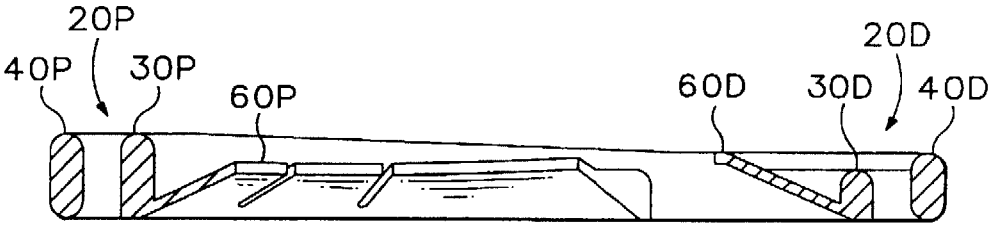
FIG. 4C is a sectional view taken through the plane C—C of FIG. 2.
Figure 4D:
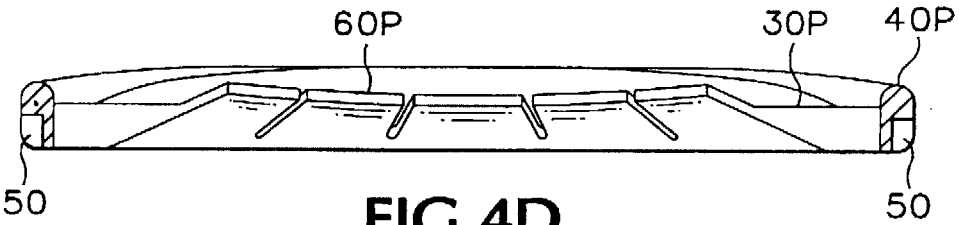
FIG. 4D is a sectional view taken through the plane D—D of FIG. 2.
Figure 4:
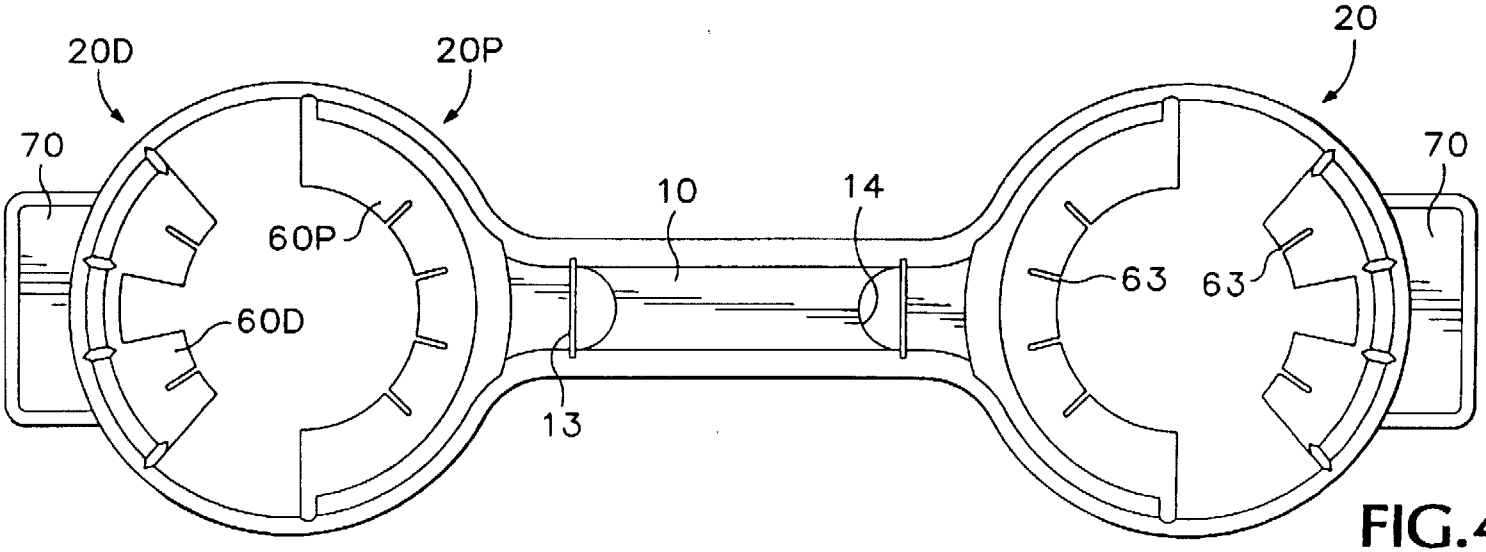
FIG. 4 is a bottom view of the carrier shown in FIG. 2.

Referring to the drawings, wherein the like numerals refer to the same elements, there is shown in FIGS. 1, 2 and 4 an integral two-ring carrier 1 for carrying a pair of containers having annular flanges in their necks, the carrier consisting of an elongate strap 10 having elongate ribs 11, the strap connecting a pair of symmetrical neck-engaging ring structures 20, each neck-engaging ring structure comprising a proximal weight-bearing structure 20P and a distal neck-capturing and -releasing structure 20D, the proximal and distal portions each including approximately 180 radial degrees. Each neck-engaging ring structure is identical and comprises an inner distal arcuate rib 30D and an inner proximal arcuate rib 30P, the proximal rib 30P preferably having greater tensile strength than distal rib 30D, best seen in the sectional view comprising FIG. 4C, where the cross-sectional area 30P is seen to be larger than the cross-sectional area 30D. Inner arcuate ribs 30P and 30D are within outer circumferential rib 40, the latter having a proximal portion 40P and a distal portion 40D. Similarly, outer circumferential rib 40 preferably tapers slightly from proximal portion 40P to distal portion 40D, also best seen in FIG. 4C. Inner arcuate ribs 30P and 30D are radially connected to outer circumferential rib 40 by a series of radially inwardly projecting tapered ribs 43, which also serve to reinforce flanges 60P and 60D.

Inner edges of flanges 60P and 60D form a circle, the center of which is offset relative to the common center of outer circumferential rib 40 and arcuate rib 30 toward the proximal portion 20P of the neck-engaging ring structure, so as to shift the center of gravity of the container to be carried toward the proximal weight-engaging structure 20P. Inner distal arcuate rib 30D preferably is discontinuous, as seen in FIGS. 2 and 3.

A pair of notches 50 are provided on the bottom side of outer rib 40, the notches permitting flexible upward hinging of the distal neck-capturing and -releasing structure 20D relative to the proximal weight-bearing structure 20P. Inner ribs 30P and 30D are provided with a plurality of radially inwardly and slightly upwardly projecting flanges 60P and 60D located on the proximal and distal sides, respectively. Both sets of flanges 60P and 60D converge to a common central point above the plane of the strap, and, taken together, constitute sections of a truncated cone. Flanges 60D project slightly further inwardly than flanges 60P and have greater flex and less tensile strength than flanges 60P. To achieve such a differential in flexibility, flanges 60P are preferably thicker in gauge than are distal flanges 60D, best seen in FIG. 4C. In a preferred embodiment, the thickness or gauge of flanges 60P on the proximal side is 45–55 mils, while flanges 60D on the distal side are $\geqq 10$ mils thinner. Flanges 60P and 60D are preferably provided with slots 63 so as to permit a degree of distortion while securing the neck-engaging ring structures to a pair of containers having annular flanges in their necks, and also while disengaging the ring structures from the container necks.

Figure 3:
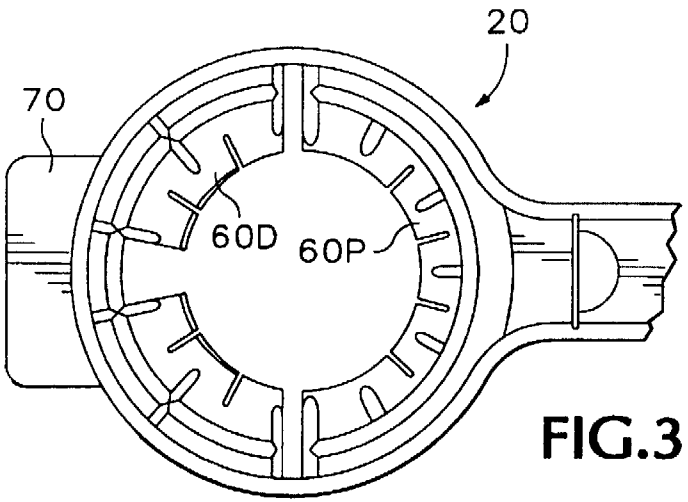
FIG. 3 shows a variation in the configuration of the flanges of the neck-engaging ring structure of the carrier.

In an especially preferred embodiment, the number of inwardly projecting flanges 60D is fewer than the number of flanges 60P, and the flanges 60D are discontinuous, the discontinuity most preferably being in the vicinity of where notches 50 are located on neck-engaging ring structure 20 and in the area of the distal apex of the neck-engaging structure, best seen in FIGS. 2 and 3.

In a preferred embodiment, outer circumferential rib 40 is seen to constitute a continuation of elongate ribs 11 on each side of the strap 10, such a structure tending to resist any torquing or twisting of the neck-engaging ring structures 20 relative to each other. Grip ribs 11 are preferably radiused on both sides 11A and 11B, best seen in FIG. 4B, the two radiuses 11A and 11B also combining to provide a comfortable grip that is less likely to cut or form welts on the hand when in use. Strap 10 is also preferably provided with anti-nesting bridges 13 to prevent jamming during automated application of the carriers to containers, and with weep holes 14 to prevent accumulation of moisture in the grip portion of the straps, both being conventional features.

Carrier 1 is preferably made of a flexible material such as a polyolefin; in a most preferred embodiment the polyolefin is high density polyethylene that has a tensile strength of from about 4,000 to about 5,000 psi, a flexural strength of at least 65 psi and a brittleness temperature of less than −50° C.

As may be apparent, the structure of the present invention provides a neck-capturing and neck-releasing portion 20D in the distal portion of the neck-engaging structure by virtue of the lower tensile strength of distal arcuate rib 30D and the fewer number of flanges 60D that have greater flexibility and that project further inwardly than do flanges 60P, at the same time providing a weight-bearing structure 20P that, by virtue of its greater number of higher tensile strength flanges 60P and higher tensile strength inner proximal arcuate rib 30P, resists any downward torquing of proximal flanges 60P, thus preventing proximal flanges 60P from rolling upwardly from under the annular flange on the neck of a container. Furthermore, the provision of an offset center of the inner edges of flanges 60P and 60D relative to the rib structures 30 and 40 not only shifts the center of gravity of the container to be carried to the force- and weight-bearing proximal flanges 60P as mentioned above, but also allows greater leverage to be applied to lift the distal flanges 60D outwardly and upwardly to quickly and easily disengage the carrier strap 1 from the container neck. To assist in the manual disengagement of the carrier from the neck of a container, outer circumferential rib 40 is optionally provided with a pry tab 70 at the apex of the distal portion of outer circumferential rib 40D, as shown in FIG. 2.

EXAMPLE

A carrier strap of substantially the same design shown in FIG. 2 was fabricated by injection molding from high density polyethylene having a density of 0.96 g/cm$^3$, a tensile strength of 4800 psi (33 MPa), a flexural strength of 7000 psi (48 MPa) and a brittleness temperature of approximately −100° C. Flanges 60P on the proximal portion of neck-engaging ring structure 20P had a gauge of 45 mils, while flanges 60D on the distal side 20D had a gauge of 35 mils. The inner edges of proximal and distal flanges 60P and 60D were offset 1/16 inch from the centerline of outer circumferential rib 40 toward the proximal side. The so-fabricated carrier strap was easily and quickly secured over the annular flanges on the necks of a pair of 96 oz. juice-filled PET containers weighing about 6 lbs. each by placing the neck-engaging structure over the bottle caps and necks, lifting upwardly on tabs 70 so as to flex distal portion 20D upwardly relative to proximal portion 20P, then engaging the neck immediately beneath its annular flange with the proximal weight-bearing structure 30P, followed by pushing down on neck-capturing structure 30D so as to snugly engage the distal portion of the neck and at the same time pull the weight-bearing structure 30P into secure engagement with the proximal side of the neck immediately below the flange, as illustrated in FIG. 2A. The carrier secured and supported the juice containers even with a vigorous swinging, bouncing and jostling action, yet readily disengaged by simply lifting on the pry tabs 70 on the distal portion of the neck-capturing and -releasing ring structure 20D, which caused flanges 60D to pivot away from engagement with the container neck and to spread and flex downwardly so as to slide over the annular flange, thereby releasing the container.

Figure 5:
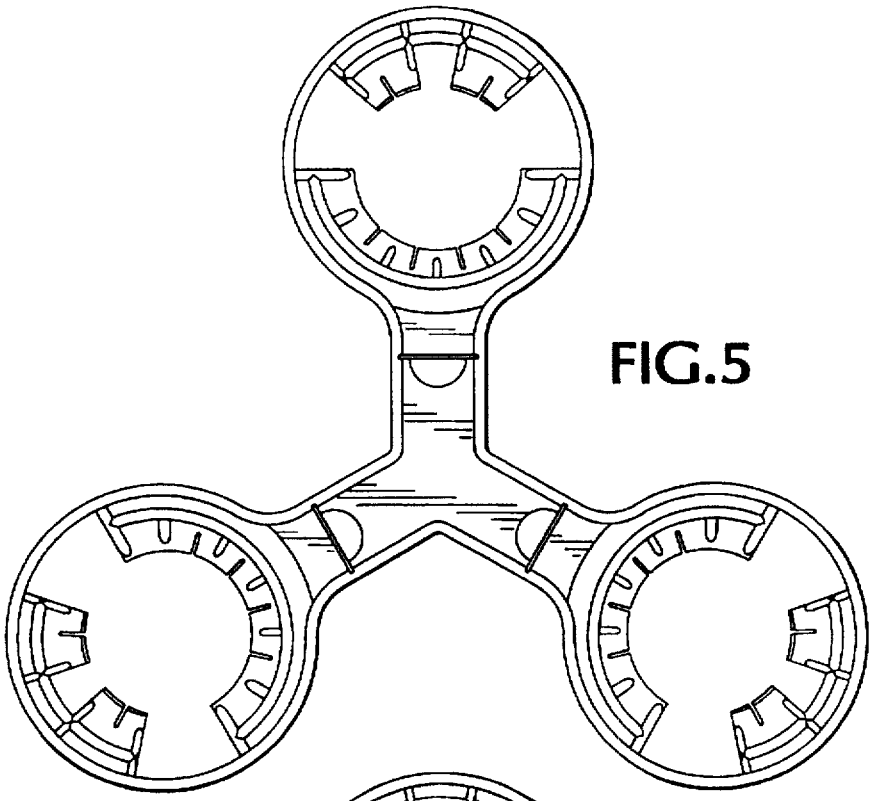
FIG. 5 is a plan view of an exemplary three-ring carrier of the present invention.
Figure 6:
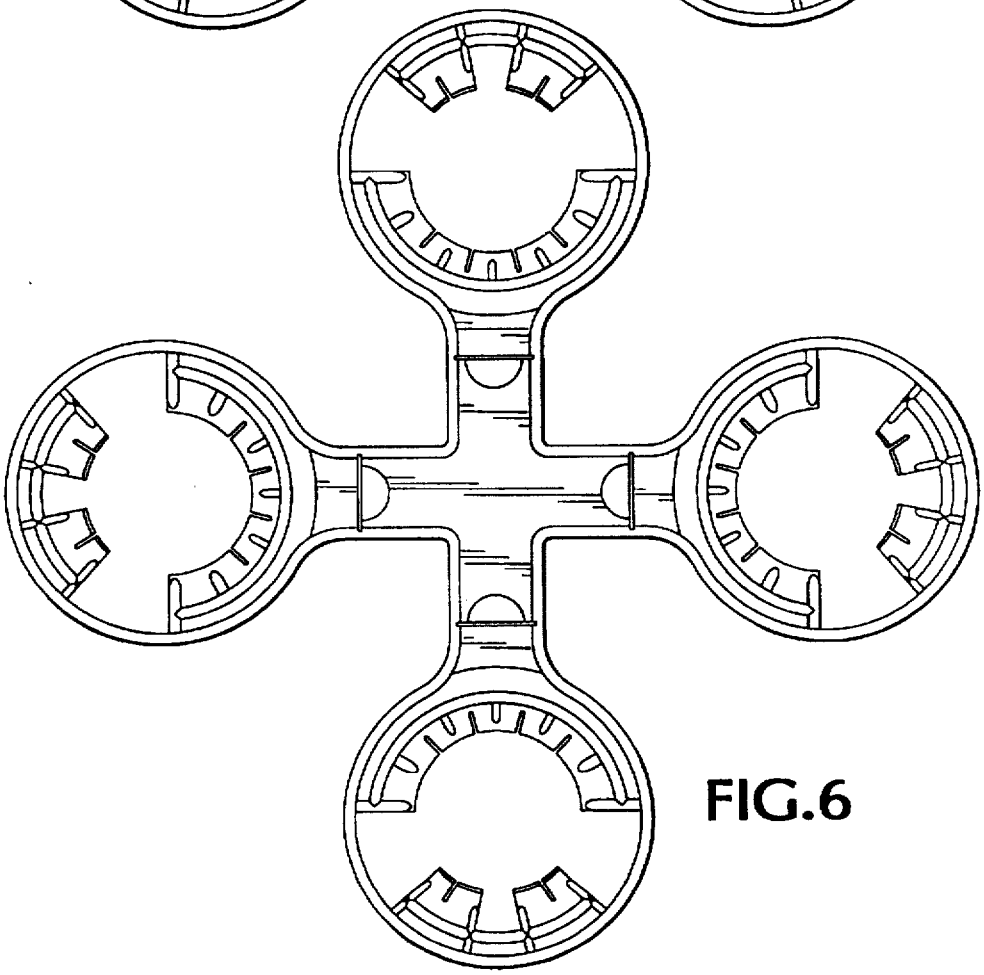
FIG. 6 is a plan view of an exemplary four-ring carrier of the present invention.

As shown in FIGS. 5 and 6, the same basic neck-engaging structures may be incorporated into three- and four-container carriers. As to FIG. 5, although a tri-star arrangement is shown connecting the three straps, virtually any geometric shape will be suitable so long as balance and comfort in carrying is achieved.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An integral carrier for carrying multiple containers having annular flanges in their necks, said carrier having top and bottom sides and consisting of at least one strap having a pair of elongate ribs connecting identical neck-engaging structures, each structure having a proximal weight-bearing portion and a distal neck-capturing and -releasing portion and comprising:

(a) an outer circumferential rib that is a continuous extension of said pair of elongate ribs;

(b) an inner proximal arcuate rib and an inner distal arcuate rib, each located within and being radially connected to said outer circumferential rib, wherein the tensile strength of the inner proximal arcuate rib is greater than that of the inner distal arcuate rib;

(c) a plurality of flanges projecting inwardly from said inner arcuate ribs wherein the flanges projecting from the distal arcuate rib project further inwardly and have greater flex and less tensile strength than do the flanges projecting from the proximal arcuate rib; and (d) a pair of notches on the bottom side of said outer circumferential rib sufficient to permit flexible hinging of the distal neck-capturing and -releasing portion relative to the proximal weight-bearing portion.

2. The carrier of claim 1 wherein said plurality of flanges are oriented upwardly toward the top side of said carrier and comprise sections of a truncated cone.

3. The carrier of claim 1 wherein the number of flanges projecting inwardly from the inner distal arcuate rib is less than the number of flanges projecting inwardly from the inner proximal arcuate rib.

4. The carrier of claim 3 wherein said flanges projecting inwardly from the inner distal arcuate rib are discontinuous.

5. The carrier of claim 4 wherein the gauge of the flanges projecting inwardly from the inner proximal arcuate rib is greater than the gauge of the flanges projecting inwardly from the inner distal arcuate rib.

6. The carrier of claim 1, including a pry tab on the distal apex of said outer circumferential rib.

7. The carrier of claim 1 made of a flexible material.

8. The carrier of claim 7 wherein said flexible material is a polyolefin.

9. The carrier of claim 8 wherein said polyolefin is high density polyethylene.

10. The carrier of claim 9 wherein said high density polyethylene has a tensile strength of from about 4000 to about 5000 psi, a flexural strength of at least 6500 psi and a brittleness temperature of less than −50° C.

* * * * *